United States Patent [19]

Higgins

[11] 4,124,041

[45] Nov. 7, 1978

[54] METHOD OF ASSEMBLING COIL SPRINGS

[75] Inventor: Larry Higgins, Carthage, Mo.

[73] Assignee: Leggett & Platt, Incorporated, Carthage, Mo.

[21] Appl. No.: 811,608

[22] Filed: Jun. 30, 1977

[51] Int. Cl.[2] ..... B21F 27/16

[52] U.S. Cl. ..... 140/3 CA; 140/92.4

[58] Field of Search ..... 5/260, 261, 266, 269; 29/446, 456; 140/3 C, 3 CA, 92.4, 92.9, 92.93, 92.94

[56] References Cited

U.S. PATENT DOCUMENTS

| | | | |
|---|---|---|---|
| 1,881,672 | 10/1932 | Kirchner | 140/92.4 |
| 1,895,429 | 1/1933 | Foster | 140/3 CA |
| 2,120,093 | 6/1938 | Foster | 5/260 |
| 2,265,426 | 12/1941 | Foster | 5/269 |
| 2,609,865 | 9/1952 | Horton et al. | 5/266 X |
| 2,644,174 | 7/1953 | Hood | 5/351 |

*Primary Examiner*—E. M. Combs

*Attorney, Agent, or Firm*—Wood, Herron & Evans

[57] ABSTRACT

A coil spring assembly having increased firmness in a preselected area of the assembly through use of a novel spring connector structure and method. The increased firmness is provided by, during fabrication, overlapping joint segments of a pair of adjacent coil springs' top loops, positioning a levelizer wire across the overlapped joint so formed, deflecting at least one of the overlapped joint segments out of its normal arcuate attitude toward a linear attitude, and wrapping a helical lacing wire around the overlapped joint segments and levelizer wire in a sufficiently tight manner to prevent the deflected joint segment from returning fully to its normal arcuate attitude, thereby maintaining the spring joint so established in a prestressed state. Preferably, this structure and method employs a single levelizer wire and a single lacing wire to connect adjacent springs in adjacent parallel rows from one end of the rows to the other.

8 Claims, 16 Drawing Figures

METHOD OF ASSEMBLING COIL SPRINGS

This invention relates to spring assemblies. More particularly, this invention relates to an improved spring assembly in which springs are joined together by a novel spring connector structure and method.

Spring assemblies, as is commonly known to the art, are generally fabricated of a plurality of individual spring units, e.g., coil springs, organized in matrix-like fashion into columns and rows. These springs are held in spatial relation relative one to the other, i.e., the rows and columns of the matrix are held in spatial relation one to the other, in the finished assembly by some type of fastener device or joint structure that interconnects adjacent springs throughout the matrix one with the other. After fabrication of the spring assembly, manufacture of a finished product is completed by placing a cushion or pad of material, e.g., woven or non-woven batting, or foam rubber, or the like, over the top and/or bottom surface of the spring assembly matrix so formed, and then enclosing that structure within an upholstered fabric or cloth sheath or the like to provide the saleable product. The finished product may be, e.g., a mattress, a box spring, a chair's seat, a chair's backrest, or the like.

It is common practice in the spring assembly art to connect adjacent individual springs within a spring matrix in both the top plane and the bottom plane of the spring assembly. In one or both planes of the spring assembly, two basic types of spring connector structures are provided, one surrounding the spring assembly in border-like fashion, and the other interconnecting adjacent springs within the matrix into adjacent rows of springs. Whether the same border connector structure, and the same row connector structure, is used in both the top and bottom planes of the spring assembly depends on the end use of the assembly, e.g., in a mattress the same border and row connector structures would be used in both the top and bottom planes since both sides of a mattress may be used as the top surface, but in a box spring different border and row connector structures are used in the top and bottom planes since the box spring only has one top surface.

One type of border connector structure well known to the art includes a single, heavy gauge wire disposed in border fashion about the periphery of the spring matrix in a top or bottom plane of that matrix. The border wire is held to the so-called border springs that define the border of the spring assembly matrix by any type of border wire fasteners known to the art, e.g., metal clips, wire spiraled around the border wire and the springs' end loops, welding, or the like. Interior adjacent coils of the spring assembly also are connected one with the other, and with the border spring rows, by row connector structure in top and bottom planes of the matrix. One type of row connector structure well known to the prior art is commonly known as a helical lacing wire. The helical lacing wire extends from one edge to another edge of a spring assembly between adjacent rows of that assembly in one plane thereof, the lacing wire connecting adjacent springs within those rows simply by being wound around the overlapped top loops thereof. In this known prior art spring connector structure, it is also known to provide a linear wire longitudinally between the adjacent rows, the linear wire extending over each joint of overlapped loops of adjacent coil springs as it extends from one edge to another of the spring assembly, the linear wire also being tied at the edges of the assembly to the assembly's border wire. But in this row connector structure, the spiral lacing wire is loosely wound around the overlapped spring loop joints, as well as the linear wire, to connect the adjacent springs in adjacent rows, i.e., to establish the row connector structure. Generally speaking, such linear edge-to-edge wires, in combination with the edge-to-edge helical lacing wires, have been provided in the past to give a degree of rigidity to the spring assembly against transverse or edge-to-edge distortion of the entire spring assembly. In other words, this prior art row connector structure has had as its objective the maintaining of the matrix's plurality of linear columns and rows in the desired linear alignment throughout the useful life of the spring assembly. Typical row connector structures of this type are illustrated in Foster U.S. Pat. No. 2,120,093, Foster U.S. Pat. No. 2,265,426, Horton et al U.S. Pat. No. 2,609,865, and Hood U.S. Pat. No. 2,644,174.

In the bedding foundation industry, i.e., in the mattress and box spring industry, customer demand in recent years has dictated that bedding foundations have greater firmness. In other words, recent customer preference in bedding foundations is one of greater firmness in mattresses and box springs, i.e., reduced softness, relative to those bedding foundations sold in earlier years. There are a couple of different basic approaches that can be used in increasing the firmness of a bedding foundation such as a mattress or box spring. One approach is simply to increase the number of springs within the bedding foundation structure. Another approach is to increase the gauge from which the springs within the bedding foundation are fabricated. However, both of these approaches result in increased fabrication costs of the bedding foundation; in the first instance because of the increased number of coils required in the spring assembly, and in the second instance because of the increased wire gauge for each of the coils in the assembly. This softness problem is also inherent in spring assemblies fabricated in accord with the spring connector structures illustrated and described in the abovementioned patents. In connection with the particular type of spring connector structure shown in those patents, the overlapped top loops of each pair of adjacent coils provide a joint which, when a force is exerted downwardly thereon, tends to promote a hinging or folding action between the adjacent coils' top loops, thereby providing the feeling of softness in the spring assembly which is now undesirable in bedding foundations. Such a downward force on the joints of adjacent coils in adjacent rows is provided, of course, by a person sitting or lying on the spring assembly.

It has been one objective of this invention, therefore, to provide a coil spring assembly with an improved spring connector structure of the spiral lacing wire type in which the spiral lacing wire is combined with a linear levelizer wire, the lacing wire, levelizer wire and the coil springs' top loops cooperating to maintain the joint segment of one of the spring coils of a joined pair in a prestressed state after manufacture of the spring assembly.

It has been another objective of this invention to provide an improved spring assembly in which a sprial lacing wire and a linear levelizer wire extend from one edge to another of the spring assembly between adjacent spring rows, the top loops of adjacent coils in the adjacent rows being overlapped, and at least one of the top loops of each coil pair being prestressed or deflected out of its normal arcuate configuration toward a linear configuration during joinder of the lacing wire and levelizer wire therewith, the lacing wire being wound tightly at all the spring joints formed between the adjacent rows so as to maintain that prestressed loop at each joint in a deflected state, thereby increasing the firmness of the spring assembly throughout that matrix area of the spring assembly so joined.

In accord with the objectives of this invention, the coil spring assembly of this invention provides an increased firmness in a preselected area of the assembly through use of a novel spring connector structure and method. The increased firmness is provided by, during fabrication, overlapping joint segments of a pair of adjacent coil springs' top loops, positioning a levelizer wire across the overlapped joint so formed, deflecting at least one of the overlapped joint segments out of its normal arcuate attitude toward a linear attitude, and wrapping a helical lacing wire around the overlapped joint segments and levelizer wire in a sufficiently tight manner to prevent the deflected joint segment from returning fully to its normal arcuate attitude, thereby maintaining the spring joint so established in a stressed state, and inhibiting hinging of the joint. Preferably, this structure and method employs a single levelizer wire and a single lacing wire to connect adjacent springs in adjacent parallel rows from one end of the rows to the other.

Other objectives and advantages of this invention will be more apparent from the following detailed description taken in conjunction with the drawings in which.

Figure 11:
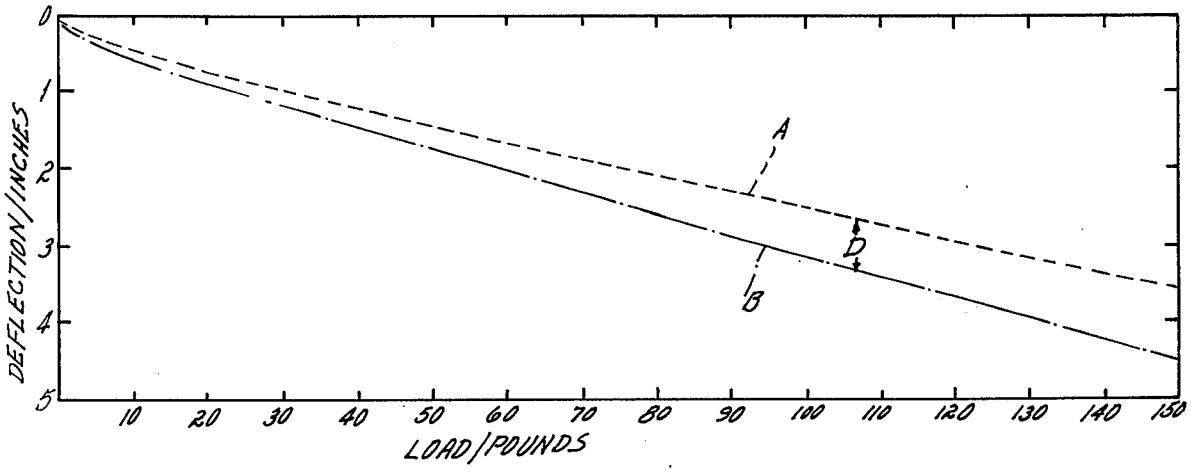
Figure 10D:
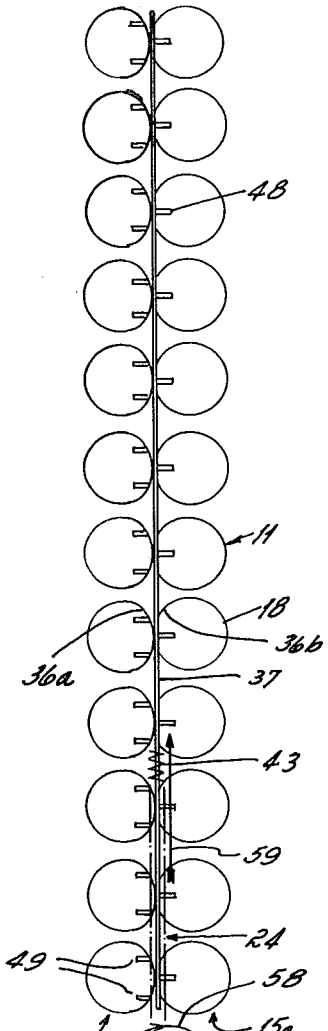
Figure 10C:
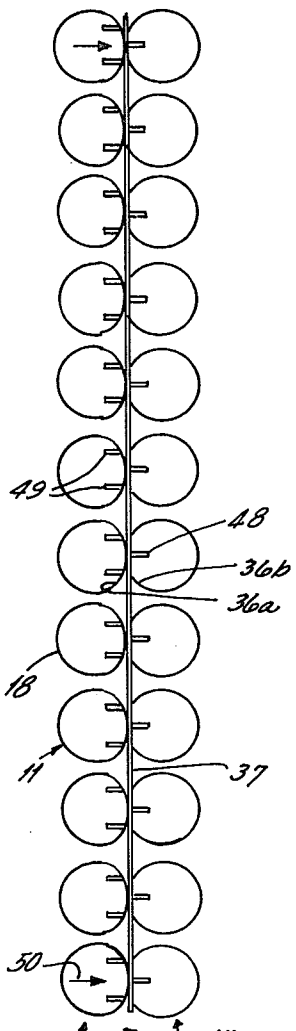
Figure 10B:
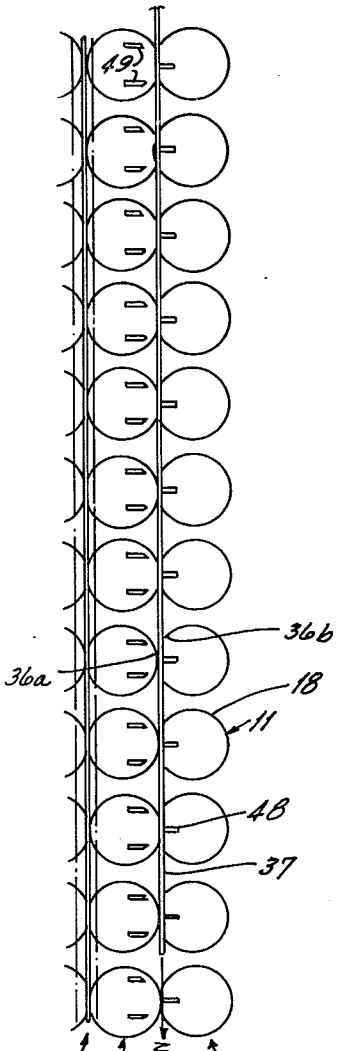
Figure 10A:
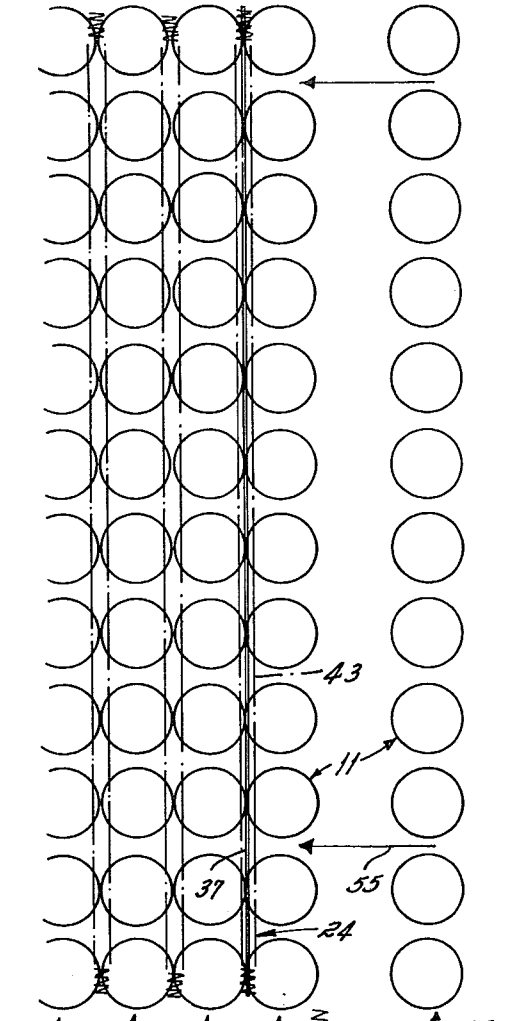

FIG. 10 illustrates a method step sequence for assembling the improved spring assembly in accord with this invention, FIG. 10A illustrating a first step, FIG. 10B illustrating a second step, FIG. 10C illustrating a third step, and FIG. 10D illustrating the last step, in assembly of adjacent rows of coil springs one with the other; and FIG. 11 is a graph illustrating improvement in firmness in a spring assembly fabricated in accord with this invention vis-a-vis firmness of a spring assembly fabricated in accord with the prior art.

Figure 1:
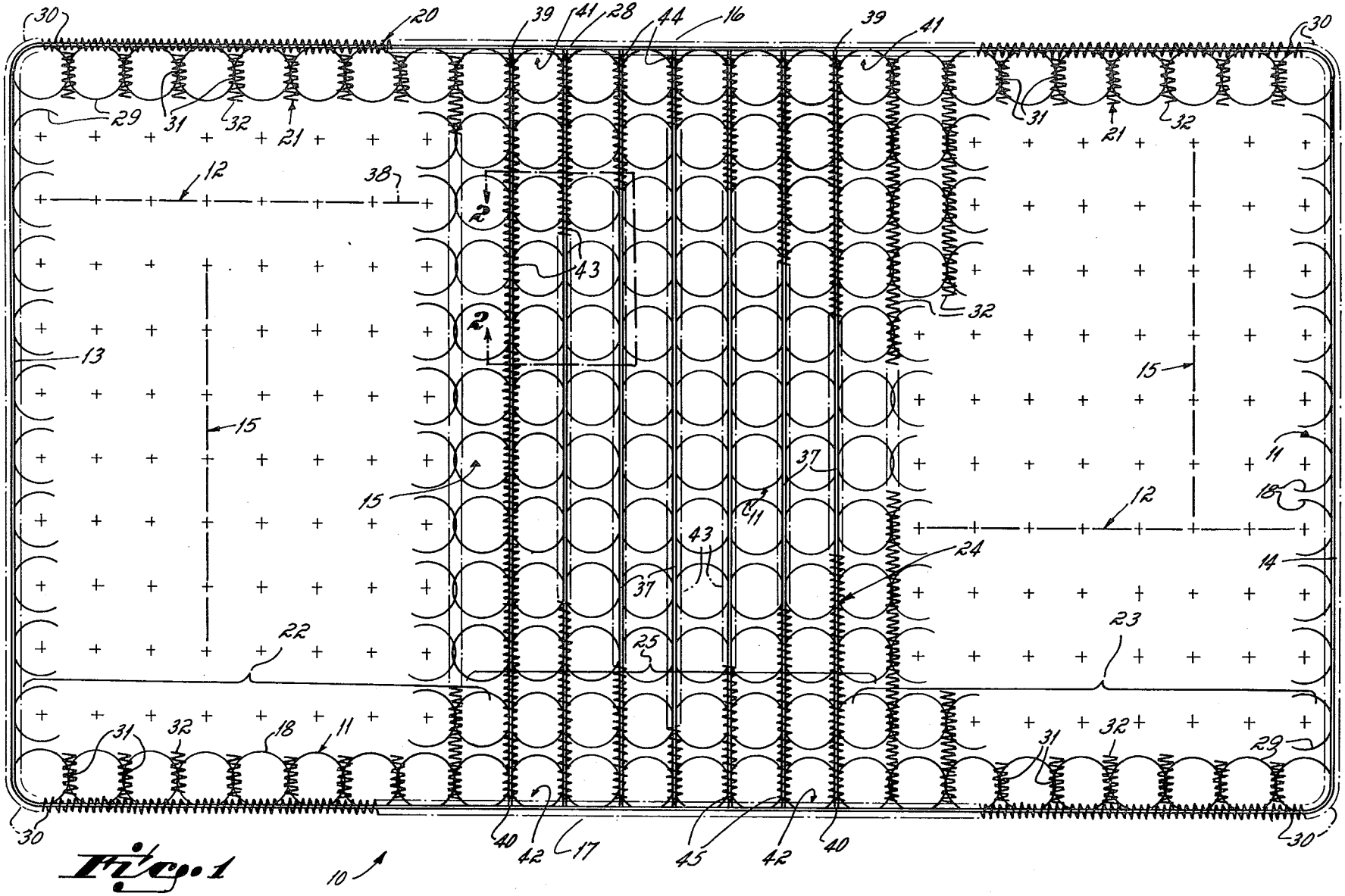
FIG. 1 is a top plan view illustrating a mattress fabricated in accord with the principles of this invention.
Figure 2:
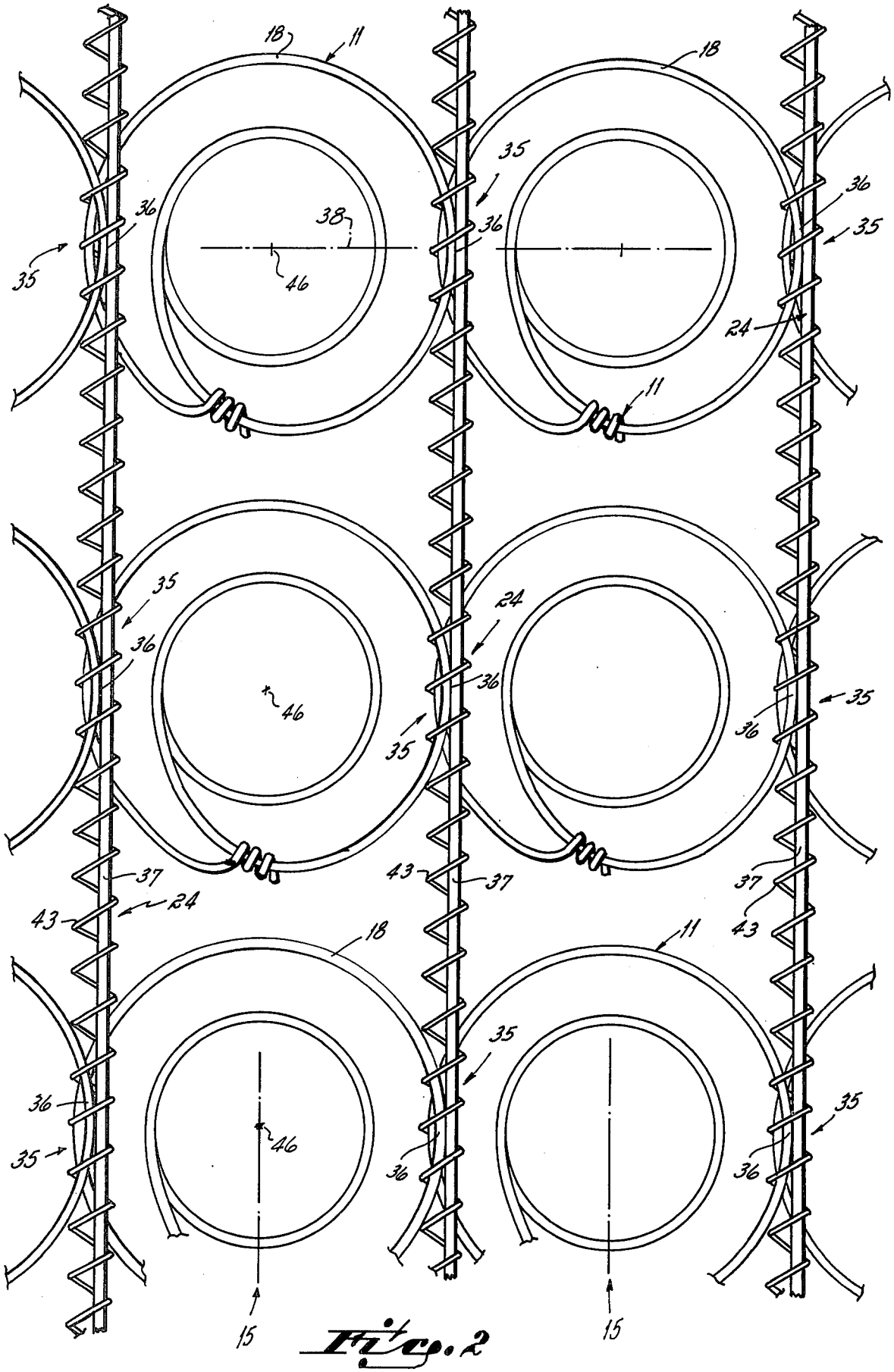
FIG. 2 is an enlarged top plan view of the encircled area of FIG. 1.

The preferred embodiment of an improved spring assembly 10 in accord with the principles of this invention as illustrated in FIGS. 1–4 and 10. As shown in FIG. 1, the improved spring assembly 10 is shown as a bedding foundation, i.e., as a mattress. It will be understood, however, that the principles of this invention are equally applicable to any spring assembly structure fabricated in accord with the structural and method concepts set out below. More particularly, the mattress 10 is comprised of a number of coil springs 11 arranged in matrix-like fashion, the coil spring matrix defining 12 columns 12 extending from one end edge 13 to the other end edge 14 of the mattress, and 24 rows 15 extending from one side edge 16 to the other side edge 17 of the mattress. The coils 11 illustrated are of the ordinary double cone or hourglass type (not shown in detail). Each of the coils includes a top circular loop 18, all of the top circular loops being oriented in the same basic horizontal plane to define the top surface of the spring assembly, and a bottom circular loop (not shown), all of the bottom loops being arranged in the same basic horizontal plane (not shown) to define the bottom surface of the spring assembly. FIGS. 1 and 2 illustrate the top horizontal surface of the mattress only, it being understood to those skilled in the art that the bottom surface of the mattress is structurally identical to the top surface thereof.

Three different types of spring connector structures are used in maintaining the multiple coil springs 11 in the matrix configuration of the mattress illustrated in FIG. 1. The first type spring connector 20 structure is a border connector structure which cooperates with the border coil springs to define the periphery of the spring assembly. The second type spring connector structure 21 is a row connector structure which connects adjacent coil springs in adjacent rows and, therefore, adjacent rows of springs, one with the other. This second type of spring connector structure is utilized to interconnect adjacent springs 11 in the first nine rows 15 of springs at each end of the spring assembly, i.e., to connect spring rows 15 in areas 22 and 23 as shown in FIG. 1. More particularly, in connection with the first type spring connector structure 20, the border connector structure includes a border wire 28 connected to the border springs 29 in the spring assembly 10 matrix. The border wire 28 is simply a length of wire extending around the border or periphery of the spring matrix in the top plane of the springs, i.e., in the top plane of the matrix, and is connected to the outer segments of the border springs' top loops by a helical lacing wire 30 spirally wound around the border wire and adjacent spring loop segments throughout the length of the border. This spring connector structure of the border type is well known to the prior art. The second type spring connector structure 21 is also illustrated in FIG. 1, and interconnects adjacent springs 11 of adjacent rows 15 in spring row areas 22, 23 of the mattress 10. In the spring connector structure 21, the adjacent top loops of adjacent spring rows 15 are overlapped one upon the other as at joints 31, and a helical lacing wire 32 is extended from one end of the adjacent rows to the other interconnecting the adjacent coil springs in those adjacent rows at the overlapped joints 31. The helical lacing wires 32 are tied to the border wire 28 at each end thereof by welding, or by being looped around the border wire, or otherwise. This spring connector structure of the row type is also well known to the prior art. The bottom-plane of the mattress (not shown) is provided with the same first 20 and second 21 connector structure for the coil springs' bottom loops (not shown) as has been described in the top plane.

The third type spring connector structure 24 is also a row connector structure, and it connects the middle eight rows 15 of springs 11 in the spring assembly 10 one with another, i.e., the spring rows 15 in area 25 as shown in FIG. 1. It is this third type spring connector structure 24, and method of spring connection, that is in accord with the principles of this invention. As previously mentioned, the improved spring connector structure 24 and method functions to increase the firmness of the coil spring matrix area 25 within which it is used. In bedding foundations, and particularly in mattresses, it is desirable that the firmness of a mattress be accentuated centrally of the end edges 13, 14 of the mattress in light of the fact that the greatest downward force from persons lying on the mattress is likely to occur in that area. The novel method and structure of this invention permits the general area 25 of increased firmness in a spring assembly 10 to be increased or decreased (depending upon the firmness effect desired for the spring assembly) simply by increasing or decreasing the number of rows 15 connected one to the other in accord with the principles of this invention. In other words, and by increasing the number of rows 15 connected in accord with the principles of this invention, the area 25 of increased firmness in a spring assembly may be increased, and by decreasing the number of spring rows 15 that are connected in accord with the principles of this invention, the area 25 of increased firmness in a spring assembly may be decreased. Further in this regard, and although the general area 25 of increased firmness as illustrated in FIG. 1 is accommodated by connecting eight side-by-side rows 15 with one another, the firmness of the mattress may be increased throughout the entire area 22, 25, 23 by simply connecting alternate pairs of adjacent spring rows, or every third pair of spring rows, or the like in accord with the principles of this invention. In a mattress environment, however, one desirable embodiment is as illustrated in FIG. 1, that figure illustrating that approximately the center one-third area 25 of the mattress, from end edge 13 to end edge 14 thereof, has adjacent springs in adjacent coil spring rows 15 connected together in accord with the principles of this invention.

Figure 3:
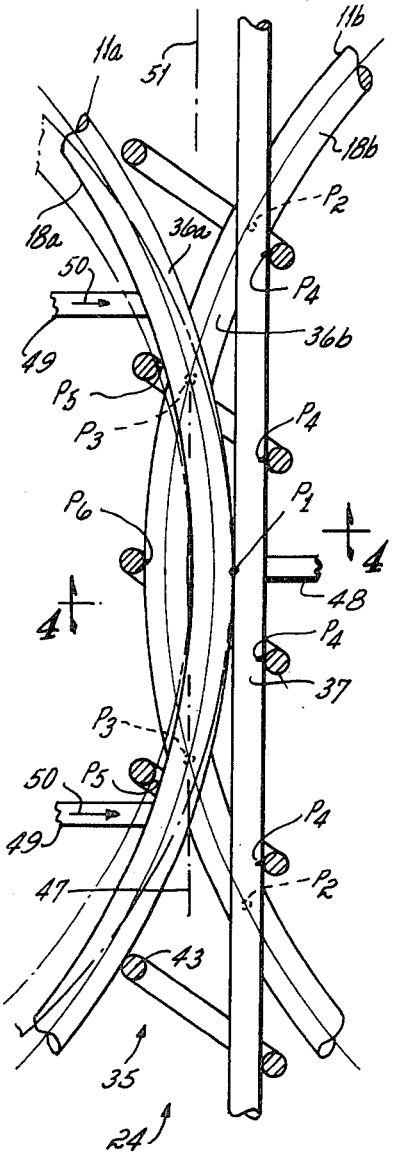
FIG. 3 is a top plan view of adjacent coils of adjacent rows illustrating the joint segment of one coil's top loop in solid lines in a prestressed or deflected attitude during assembly, that same joint segment being shown in phantom lines in the as-manufactured but pre-assembled attitude.

The center area 25 of spring rows 15 of the mattress 10 are connected together one with another, as mentioned, by the method and spring connector structure 24 in accord with the principles of this invention. The center area 25 of rows 15 is similarly connected in both the top and bottom (not shown) planes of the mattress. As illustrated in FIGS. 1–3, the connector structure 24 for each pair of adjacent rows 15 requires that the adjacent springs **11*a*, 11*b* in those adjacent rows 15 be overlapped, i.e., the top loops 18*a*, 18*b* of the adjacent springs 11*a*, 11*b* must be overlapped one upon the other, to form a spring connector or joint area generally designated at 35. In this regard, that portion of the overlapped loop 18 of each coil spring 11*a* or 11*b* within each joint area 35 is henceforth referred to as a joint segment 36. A levelizer wire 37 extends the length of the adjacent rows 15 in a direction normal to a phantom centerline 38 that connects adjacent spring pairs 11 in the columns 12. The levelizer wire 37 extends from one end 41 of the rows to the other end 42, and overlies or passes through the successive overlapped joints 15 from one end 41 of the rows to the other 42. The levelizer wire 37 is a linear wire, and is tied, e.g., by welding or by wrapping, or otherwise, to opposed side edge 16, 17 portions of the border wire 28, thereby interconnecting each end of the levelizer wire with the border wire as at 39, 40. A spiral lacing wire 43 also extends from one end 41 of the adjacent rows 15 to the other 42, the spiral lacing wire also being tied to the side edge 16, 17 portions of the border wire 28 at each end as at 44, 45. The spiral lacing wire 43 embraces each of the joints 35 between adjacent springs 11*a*, 11*b* in adjacent rows 15, and also embraces the levelizer wire 37, as it extends from one end 41 of those rows to the other 42. The important and novel feature of the structure and method of this invention is that the spring connector joint so formed between each pair 11*a*, 11*b* of adjacent springs in adjacent rows 15 is formed by tightly widing the spiral lacing wire 43 therearound in a manner that causes a joint segment 36*a* or 36*b* of at least one of the spring's top loops 18 to remain in a deflected or stressed attitude after assembly (see solid line configuration of FIG. 3A), as opposed to that joint segment's normal or as-manufactured arcuate attitude (see phantom line configuration of FIG. 3A), thereby placing each joint 35 so formed under a force relationship that tends to resist or impede hinging or folding action at that joint upon a downward force 33 (see FIG. 4), e.g., as exerted by a person lying thereon, being presented at that joint. The essence of the invention at each spring connector joint 35, therefore, is one of tightly winding the lacing wire 43 around the overlapped top loops' joint segments 36 and levelizer wire 37 at each joint so as to provide a joint in which all of the wires within that joint, i.e., the levelizer wire 37, the joint segments 36 of the adjacent springs' top loops 18*a*, 18*b*, and the spiral lacing wire 43**, are bound up in a compression force or pressure type relationship as explained in further detail below.

The substance of a preferred joint 35 provided by the spring connector structure 24 and method of this invention is illustrated particularly in FIGS. 3, 3A, 4 and 4A. Those figures illustrate a single joint 35 of top loops **18*a*, 18*b* of adjacent coil springs 11*a*, 11*b* at various stages prior to, during, and after assembly of the joint 35 in area 25 of the mattress 10. The joint 35 includes the joint segment 36*a* of a first coil's top loop 18 overlying or overlapping the joint segment 36*b* of a second coil's top loop 18*b*, a levelizer wire 37 also overlying the joint segment 36*b* of the second coil's top loop 18*b*, and a helical lacing wire 43 spiraled or wound therearound. The joint structure 24 of this invention is predicated upon the concept of first deflecting or prestressing the top loop 18*a* of the first coil of the overlapped adjacent coils 11*a*, 11*b* out of its normal or as-manufactured arcuate attitude (see phantom lines of FIG. 3) toward a linear attitude (see solid lines of FIG. 3). The top loop 18*a* is susceptible to such deflection because it is fabricated of spring wire. In other words, the joint segment 36*a* of the top loop 18*a* of a coil spring 11*a* as-manufactured (and prior to assembly into a spring assembly 10, i.e., prior to being integrated into the mattress 10 matrix configuration), is fixed in an arcuate attitude having a center point 46 that is also the center point of the circular top loop 18**, see phantom line configuration of FIG.

3. This arcuate segment 36a of at least one of the overlapped coil spring loops 18a, 18b is flexed or deflected or prestressed out of that normal unstressed arcuate attitude so that, prior to final assembly into the joint 36 of this invention, that segment 36a of the coil spring's top loop 18a is significantly deflected from its unstressed arcuate attitude toward a linear attitude, see solid line configuration of FIG. 3. While in the significantly deflected attitude (solid lines of FIG. 3) the spiral lacing wire 43 is tightly wrapped around the coil springs' joint segments 36a, 36b and the levelizer wire 37, also as shown in solid lines in FIG. 3. After the joint 35 is so wrapped with the lacing wire 43, the natural resilience inherent in the spring wire from which the coil spring 11a is fabricated, causes the joint segment 36a of the coil spring's top loop 18a to tend to return back toward its original unstressed or nondeflected attitude as shown in phantom lines in FIG. 3A. But the tightness of the wrapping of the lacing wire 43 around the joint 35 prevents the joint segment 36a of that loop 18a from completely returning or springing back to the phantom line attitude illustrated in FIG. 3A, that joint segment being stopped at a still stressed or partially deflected attitude illustrated in solid lines in FIG. 3A. Thus, and although the joint segment 36a of the coil spring's top loop 18a does tend to return or spring back toward its normal or nondeflected attitude (shown in phantom lines in FIG. 3A), it does not reach its zero or original arcuate position because it is restrained therefrom by the helical lacing wire 43 wound tightly around the joint 35. This spring connector structure 24 results in compressive forces generated between, and therefore zero clearance between, the levelizer wire 37 and the first coil spring's top loop 18a at points $P_1$, between the levelizer wire 37 and the second coil spring's top loop 18b at points $P_2$, between the first coil spring's joint segment 36a and the second coil spring's joint segment 36b at points $P_3$, between the lacing wire 43 and the levelizer wire 37 at points $P_4$, between the lacing wire 43 and the first coil spring's joint segment 36a at points $P_5$, and between the lacing wire 43 and the second coil spring's joint segment 36b at points $P_6$, see FIG. 4.

Make-up or assembly of the spring connector structure 24 is also illustrated in FIG. 3. As shown in that figure, a single stationary die arm 48 butts the linear levelizer wire 37 on one side thereof, the arcuate segment 36b of the second coil spring's top loop 18b being disposed immediately thereunder and in contact therewith. The joint segment 36a of the first or adjacent coil spring's top loop 18a is butted against the levelizer wire 37 on the other side thereof, and is overlapped on top of the joint segment 36b of the adjacent coil spring's top loop 18b. The joint segment 36a of the first coil spring's top loop is deflected from its original or as-manufactured attitude illustrated by phantom lines in FIG. 3, into a substantially deflected or precompressed attitude illustrated by solid lines in FIG. 3, by virtue of movable die arms 49 exerting a force in a direction illustrated by arrows 50 toward the levelizer wire 37 against that spring wire segment 36a. This force 50, of course, causes the spring wire segment 36a to deflect or bend significantly from its normal, unstressed arcuate attitude toward a linear attitude, thereby precompressing that coil spring's joint segment. While in this precompressed or deflected attitude, the helical lacing wire 43 is wound helically around the joint in a relatively tight relationship as illustrated in solid lines in FIG. 3. The lacing wire 43 is preformed into a helix configuration of predetermined dimensional characteristics prior to interengagement with joint 35, the connected relation with the joint being achieved simply by rotating that lacing wire while simultaneously moving it parallel to the levelizer wire 37 from one end of the joint to the other. Subsequently, the force 50, and the dies 48, 49, are withdrawn from interengagement with the joint segment 36a and levelizer wire 37, and the joint segment 36a springs back to its finished assembly attitude shown in solid lines in FIG. 3A, the dimensional characteristics of the lacing wire 43 being such that the joint segment 36a is retained in a deflected attitude in finished assembly as explained in detail above.

Figure 3A:
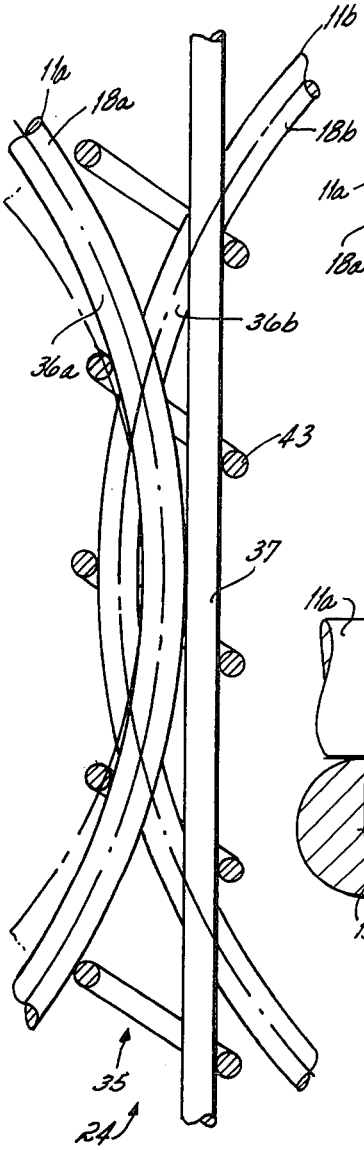
FIG. 3A is a view similar to FIG. 3 but illustrating that joint segment in the as-assembled attitude in which some degree of prestress or deflection remains as shown in solid lines, that same joint segment being shown in phantom lines in the as-manufactured but pre-assembled attitude.
Figure 4:
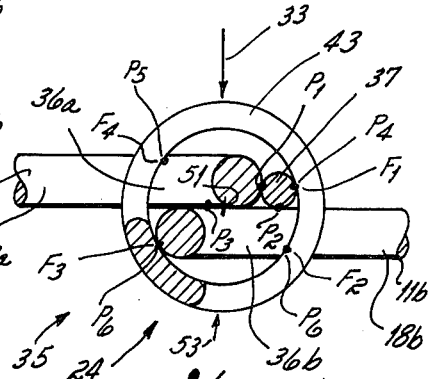
FIG. 4 is a cross-sectional view taken along line 4—4 of FIG. 3.
Figure 4A:
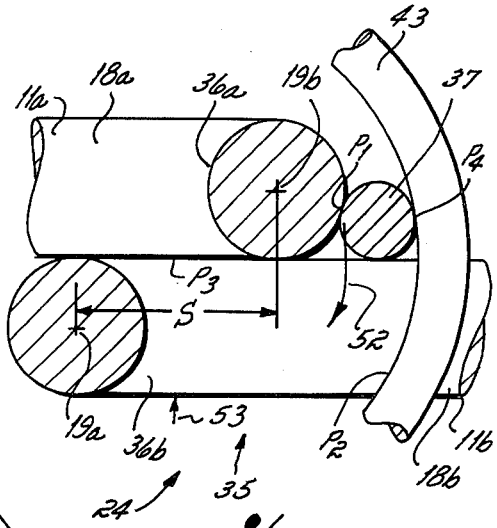
FIG. 4A is an enlarged view of the encircled portion of FIG. 4.

The force effect generated in preferred embodiments of the spring connector structure 24 illustrated in FIGS. 3 and 3A is shown particularly in FIGS. 4 and 4A. As shown in FIG. 4, note particularly that the diameter of the levelizer wire is less than the diameter of the joint segments 36a, 36b of the first 11a and second 11b coil spring's top loops 18. Note further that the levelizer wire 37 is disposed between the outside periphery of the joint segment 36a of the top loop 18a and the inside periphery of the lacing wire 43. The tight winding or binding of the first and second coil springs' joint segments 36a, 36b with the levelizer wire 37 by the helical lacing wire 43, along with the residual deflection in joint segment 36a, causes inwardly directed compressive forces $F_1$, $F_2$, $F_3$ and $F_4$ to be built-in within the joint structure 35 so formed. As a downward pressure (as indicated by arrow 33) is exerted on the spring joint 35, much as might be exerted by a person lying on the mattress above the joint, the coil springs 11a, 11b obviously deflect. And upon deflection, the overlapped or joint segments 36a, 36b of the adjacent coil springs tend to rotate or pivot about contact points $P_3$ (i.e., the contact points $P_3$ define a phantom hinge axis 47 about which the adjacent coil springs' top loops 18a, 18b pivot) as the downward pressure 33 is exerted on the joint. Although the contact points $P_3$ of the coil springs' top loops 18a, 18b tend to shift during the hinging action in response to the downward pressure 33, the center-to-center lateral dimensional spread S between centers 19a, 19b of the adjacent coil springs' joint segments 36a, 36b (as viewed in a vertical plane normal to the longitudinal axis 51 of that joint as shown in FIG. 4), will remain constant because of the fact that the joint itself has been tightly wound to generate the built-in forces $F_1$–$F_4$ therein. Since the joint 35 itself cannot expand in response to the downward pressure 33 thereon because the center 19a to center 19b spread is maintained during the hinging action through the degrees of rotation applicable as preserved by spiral lacing wire 43, the arc of rotation 52 further increases the forces $F_1$–$F_4$ in response to that downward pressure 33. As a consequence, the vertical levelizing reaction force illustrated by arrow 53 is increased over that reaction force 53 initially built-in to the joint 35 because of the residual deflection in the coil spring's joint segment 36a after assembly. This reaction force 53 is generated in a vertical plane at points $P_1$–$P_6$ within the confines of the helical lacing wire 43. As a result, the hinging action at joint area 35 is minimized, and an increase in firmness of the coil spring matrix 10 within that joint area 35 is then achieved at no detriment to the function of the coil springs 11 themselves. This for the reason that the downward force 33 at a given joint 35 is thereby transferred to adjacent coils 11. In the preferred embodiment illustrated in FIG. 1–4, the degree of levelizing effect for any one coil spring 11 configuration is primarily dependent on the functional relationship of coil spring wire diameter and levelizer wire diameter where the levelizer wire diameter must be smaller than the coil spring wire diameter, in addition to the amount of deflection maintained in the coil spring's joint segment 36*a* after assembly of the joint structure 35 as a result of the tightness of the winding of the helical lacing wire thereabout.

The effect of the spring connector structure 24, and method of assembly, according to the principles of this invention, vis-a-vis a prior art connector structure, on a spring assembly matrix, is illustrated in FIG. 11. FIG. 11 includes graph A illustrating deflection of a spring assembly structured in accord with the center area 25 illustrated in FIG. 1 (i.e., in accord with the principles of this invention), and also includes graph B which illustrates deflection of a spring assembly structured in accord with an end area 22 or 23 illustrated in FIG. 1 (i.e., in accord with the prior art). In each instance, the spring assemblies were tested by deflecting same through the use of a load on an 11 ½ inches by 11 ½ inches planar platen positioned on top the spring assembly. The graph illustrates the length of deflection in inches for a given load in pounds on the planar platen. Note particularly that the deflection distance for the spring assembly whose test results are shown in graph A is always less than the deflection distance for the spring assembly whose test results are shown in graph B at any given pounds of load, thereby indicating the levelizing effect of the joint structure 24 and method in accord with the principles of this invention vis-a-vis the prior art. Also note that the gap or distance D between graphs A and B increases as the load in pounds increases on the spring assembly under test, thereby indicating that the levelizing effect of the joint structure 24 and method in accord with this invention becomes even more pronounced, vis-a-vis the prior art, the greater the load applied to the spring assembly under test. Note that this increase in the firmness of the spring assembly is effected at substantially no increase in materials' cost, thereby permitting the manufacturer to either (a) fabricate a spring assembly having increased firmness over the same spring assembly without the joint structure 24 of this invention, or (b) fabricate a spring assembly having the same firmness as a spring assembly without the connector structure 24, but with a lesser number of springs in that spring assembly because of the increased firmness provided by the connector structure 24. In other words, and with spring assemblies having the same spring count, a spring connector structure 24 and method in accord with the principles of this invention establishes an increased firmness in the spring assembly. On the other hand, a spring assembly of a given firmness can be maintained at that firmness level, but with a lesser coil count, i.e., with a lesser number of coil springs within the assembly, by utilizing the spring connector structure 24 of this invention.

Generally speaking, it has been found that merely inserting a linear wire loosely within the helical lacing wire (as in accord with the prior art set forth in the patents referred to above) might increase the firmness of the particular spring matrix area so structured about 5% or so over the firmness of prior art area 22 or 23 shown in FIG. 1. However, upon structuring the spring matrix in accord with the invention area 25 as illustrated in FIG. 1, i.e., in accord with the principles of this invention, the firmness of the resulting product is improved by as much as 25% to 33%.

Assembly of a coil spring assembly in accord with the principles of this invention is illustrated in FIGS. 10A–10B. As shown in FIG. 10A, a group of coil springs 11 is established in row form and, thereafter, moved in the direction of arrow 55 to establish adjacent springs 11 in pairs in adjacent rows 15*a*, 15*b* with that area portion 56 of the spring assembly already fabricated. As is apparent from FIG. 10A, row 15*b* has been previously connected to other rows 15*c*, 15*d*, 15*e* in accord with the principles of the invention. As illustrated in FIG. 10B, adjacent springs 11 in adjacent rows 15, 15*b* present the joint segments 36*a* of coil springs top loops 18 in overlapped relation on top of joint segments 36*b* of the coil spring's top loops 18, all as illustrated in greater detail in FIGS. 3, 3A, 4 and 4A as described above. In this overlapping preliminary attitude, the levelizer wire 37 is extended or positioned across the successive joint areas 35 from one end 41 of the rows 15 to the other 42. Further, and as shown in FIG. 10B, laterally stationary die arms 48 are lowered into butting relation with the levelizer wire 37 on one side of that levelizer wire within the top loops 18 and laterally movable die arms 49 are lowered into spaced relation with the joint segments 36*a* within the top loops 18. As shown in FIG. 10C, subsequently the laterally movable die arms 49 are forced in tandem in the direction of arrow 50 against the joint segments 36*a* of the previously connected row's top loops 18, thereby deflecting same out of their normal unstressed arcuate attitude toward a linear attitude against the levelizer wire 37 as illustrated in greater detail in FIG. 3. With the movable die arms 49 flexing or deflecting the joint segments 36*a* of the coil springs' top loops 18 in the previously connected row 15*b* against the levelizer wire 37 restrained in place by stationary die arm 48, a helical lacing wire 43 is wound or rotated (as shown by directional arrow 58) around the levelizer wire from one edge 17 of the spring assembly to the other 16 in the direction shown by directional arrow 59, all as illustrated in FIG. 10D. The spiral lacing wire 43 is of a predetermined or preset configuration, and is dimensionally stable, so that it can be rotated from one end thereof. As the spiral lacing wire 43 is so wound, it automatically wraps the overlapped joint segments 36*a*, 36*b* of adjacent coil springs' top loops 18 into assembled relation with the levelizer wire 37. Once the lacing wire 43 has been so wrapped from one end 41 of the adjacent rows 15*a*, 15*b* to the other 42, the stationary dies arms 48 and the movable die arms 49 are removed from operational relation with the coil springs' top loops 18 and levelizer wire 37 so as to permit the deflected joint segments 36*a* of those top loops to return toward their normal unstressed or undeflected attitude shown in the connector for rows 15*b* and 15*c* of FIG. 10A. But the joint segments 36*a* cannot completely return to the nondeflected attitude because the sizing of lacing wire 43 prevents it as illustrated more clearly in FIG. 3A, thereby establishing the stressed or compression joints 35 illustrated in detail in FIGS. 3A and 4. Of course, successive rows of coil springs 11 are added in like manner, i.e., the FIG. 10A-FIG. 10D sequence is repeated until the spring assembly 10 matrix is provided with the number of rows 15 and columns 12 of coil springs 11 as desired.

Figure 5:
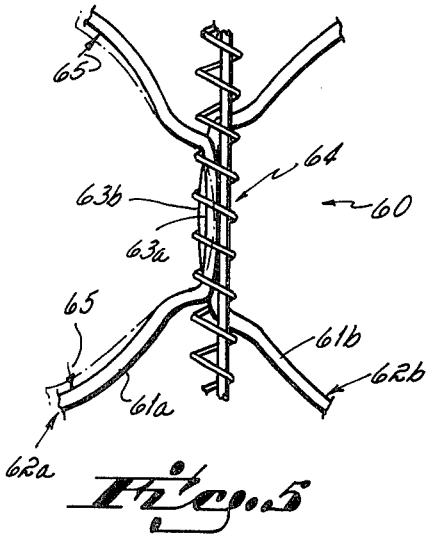
FIG. 5 is a top plan view similar to FIG. 3 but illustrating one alternative embodiment of this invention.

A first alternative embodiment of a joint structure 60 assembled and fabricated in accordance with the principles of this invention is illustrated in FIG. 5. Assembly of the FIG. 5 joint structure 60 is accomplished in a manner identical to that method illustrated in FIGS. 10A–10D for the preferred embodiment of FIGS. 1–4A. The only difference in joint structure 60 from joint structure 24 is in the configuration or geometry of the top loops 61*a*, 61*b* of adjacent coils 62*a*, 62*b*. As shown in FIG. 5, each joint segment 63*a*, 63*b* within joint area 64 of the adjacent coil springs' top loops 61 is comprised of an offset section which are overlapped one on top the other. This offset section of one 61*a* of the top loops 61 is, however, precompressed or deflected by exerting forces against the adjacent non-joint segment portions thereon as illustrated by force arrows 65. As with the preferred joint structure 24 embodiment, the deflected or precompressed attitude of that top loop's joint segment 63*a* is retained or maintained to a degree after assembly with the spiral lacing wire 43 by virtue of the lacing wire being tightly wrapped in helical fashion about the joint.

Figure 6:
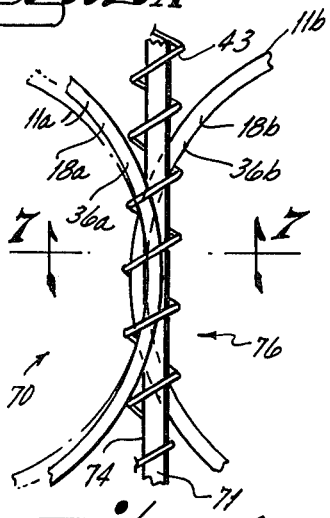
FIG. 6 is a top plan view similar to FIG. 3 but illustrating a second alternative embodiment of this invention.
Figure 7:
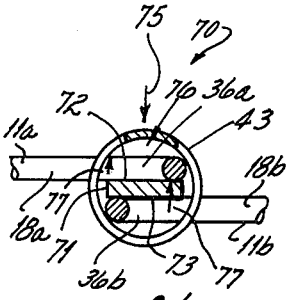
FIG. 7 is a cross-sectional view taken along line 7—7 of FIG. 6.

A second alternative embodiment in accord with the principles of this invention is illustrated in FIGS. 6 and 7. As shown in those figures, the joint structure 70 is fabricated of a flat levelizer strip 71, as opposed to the round levelizer wire 37 in the embodiments illustrated in FIGS. 1–5. The flat strip 71 is arranged with its top 72 and bottom 73 faces parallel to the top and bottom surfaces of the spring assembly, and the flat strip is interleaved or positioned between overlapping joint segments 36*a*, 36*b* of the adjacent coil springs' top loops 18*a*, 18*b* in joint area 76. In this second embodiment, as in the preferred embodiment illustrated in FIG. 3, one of the coil springs' loops 18*a* is deflected or precompressed out of its normal circular or arcuate attitude illustrated in phantom lines into an assembly attitude, not shown. That arcuate joint segment 36*a* of the coil spring's top loop 18*a* is then permitted to return partially toward its nondeflected or original attitude into the assembled or fabricated position of the joint structure 70 after wrapping with lacing wire 43 as illustrated in solid lines in FIGS. 6 and 7. Of course, the joint structure 70 is maintained under compression because the helical lacing wire 43 has been tightly wrapped in the joint area 76. In this particular structural configuration, and as illustrated in FIG. 7, when a pressure is exerted downwardly on the joint structure as shown by arrow 75, hinging action of the adjacent coil springs' top loops 18*a*, 18*b* on hinge axis 74 is minimized because of the reaction forces generated upwardly as shown by arrows 77. Thus, the second alternative of this embodiment also imparts firmness to a spring assembly having such joints 70 therein.

Figure 8:
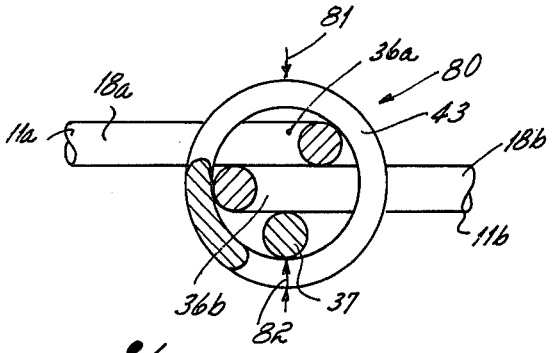
FIG. 8 is a cross-sectional view similar to FIG. 4 illustrating a third embodiment of this invention.

A third embodiment in accord with the principles of this invention is illustrated in FIG. 8. As shown in that figure, the joint segments 36*a*, 36*b* of adjacent coil springs' top loops 18*a*, 18*b* are overlapped one on top the other with the linear levelizer wire 37 positioned beneath the bottom joint segment 36*b* of each joint 80 from one end of each coil spring row to the other. As with the earlier embodiments, the helical lacing wire 43 is tightly wound around each joint 80 from one end of each coil spring row to the other after the coil springs' joint segments 36*a* have been all precompressed or deflected out of their normal or at-rest attitude. Also as with the earlier embodiments, the tight winding of the helical lacing wire 43 around the joint 80 so fabricated prevents the one coil springs' joint segments 36*a* from returning to normal or rest position, thereby maintaining compressive forces within the joint 80. In this particular embodiment, it is important that the ends (not shown) of the linear levelizer wire 37 be tied to another component of the spring assembly, e.g., the side edge border wires 28, so as to retain maximum advantages generated during assembly of the embodiment. A downwardly directed force 81 on joint 80 results in a levelizing reaction force 82 as shown in FIG. 8.

Figure 9:
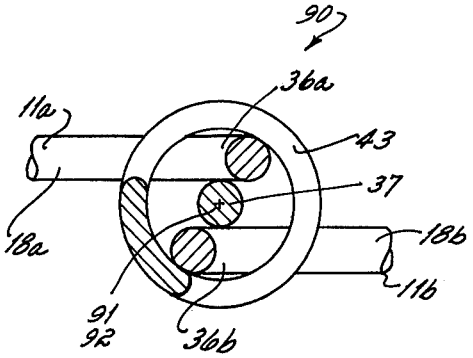
FIG. 9 is a cross-sectional view similar to FIG. 4 illustrating a fourth embodiment of this invention.

A fourth embodiment in accord with the principles of this invention is illustrated in FIG. 9. As shown in that figure, the joint segments 36*a*, 36*b* of adjacent coil spring top loops 18*a*, 18*b* are overlapped one on top the other, but with the linear levelizer wire 37 extending therebetween. In other words, and in the FIG. 9 embodiment, the joint segments 36*a*, 36*b* of the coil springs' top loops 18*a*, 18*b* do not rest one on top the other, but are separated one from the other in sandwich fashion by the linear levelizer wire 37. As in other embodiments, however, the joint segment 36*a* of top loop 18*a* is deflected out of its normal or rest attitude while the helical lacing wire 43 is wound tightly around the joint 90. The tightness of the winding of the helical lacing wire 43 around the joint structure 90 prevents that deflected joint segment 36*a* of the top loop 18*a* from returning or springing back to its original home position, also as was the case with the earlier embodiments. Note that the levelizer wire 37 has its center axis 91 coaxial with the center axis 92 of the spiral lacing wire 43 in the final joint assembly.

All of the alternative embodiments, i.e., the alternative embodiments of FIGS. 5, 6, 8 and 9, are adapted to be assembled or manufactured in accord with the method step sequence illustrated in FIGS. 10A–10D for the FIG. 1–4 embodiment. Further, each of the alternative embodiments illustrated may be used to fabricate any spring assembly product configuration (for example, a mattress 10 as illustrated in FIG. 10).

Having described in detail the preferred embodiment of my invention, what I desire to claim and protect by Letters Patent is:

1. A method of connecting adjacent springs in adjacent rows in a coil spring assembly comprising the steps of orienting a plurality of springs into a first row and a second row thereof, said rows being disposed parallel one to the other, each spring having a joint segment in the top loop thereof that is of an arcuate configuration when unconnected, overlapping joint segments of the top loops of adjacent springs in adjacent rows one with the other to form a joint area for each spring pair, positioning a levelizer wire from one end of said rows to the other, said levelizer wire passing through the joint area of each spring pair, deflecting the joint segment of the top loop of at least one spring of each pair out of its unconnected arcuate configuration toward a linear configuration, thereafter wrapping each of said joint segments and levelizer wire with a spiral lacing wire to a degree of tightness that prevents the deflected joint segment from returning completely after the deflection force thereon is released to the unstressed arcuate configuration, retaining of said deflected joint segment in a stressed arcuate configuration in the final coil spring assembly thereby providing increased firmness to that assembly over the firmness of an identical spring assembly in which neither joint segment of each spring pair and levelizer wire joint remains stressed after wrapping of the joint segments and levelizer wire with a spiral lacing wire.

2. A method as set forth in claim 1 including the step of tying said levelizer wire at each end to a border wire for said assembly.

3. A method as set forth in claim 1 including the step of establishing said lacing wire in a preformed helical configuration prior to wrapping said joints, said lacing wire retaining that same configuration after being wrapped around said joints.

4. A method as set forth in claim 1, said levelizer wire having a round cross-sectional configuration.

5. A method as set forth in claim 4, said joint segments being overlapped one on top the other, said levelizer wire overlying one of the upper and lower said joint segments and being positioned between said spiral lacing wire and the other of the upper and lower joint segments, and said levelizer wire being of a smaller diameter than the wire of said upper joint segment.

6. A method as set forth in claim 4, said levelizer wire being interposed between said joint segments. pg,28

7. A method as set forth in claim 4, said levelizer wire overlying one joint segment and contacting said one joint segment only, said levelizer wire being interposed between said one joint segment and said spiral lacing wire.

8. A method as set forth in claim 4, said levelizer wire comprising a flat strip, said flat strip being interposed between said joint segments.

* * * * *

UNITED STATES PATENT AND TRADEMARK OFFICE

CERTIFICATE OF CORRECTION

PATENT NO. : 4,124,041

DATED : November 7, 1978

INVENTOR(S) : Larry Higgins

It is certified that error appears in the above-identified patent and that said Letters Patent are hereby corrected as shown below:

Column 12, line 36 "Fig. 10" should be -- Fig. 1 --

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*